US007477204B2

(12) United States Patent
Lin et al.

(10) Patent No.: US 7,477,204 B2
(45) Date of Patent: Jan. 13, 2009

(54) PRINTED CIRCUIT BOARD BASED SMART ANTENNA

(75) Inventors: Teng-Chi Lin, Keelung (TW); Ikuroh Ichitsubo, Kanagawa Prefecture (JP); Guan-Wu Wang, Palo Alto, CA (US); Weiping Wang, Palo Alto, CA (US)

(73) Assignee: Micro-Mobio, Inc., Palo Alto, CA (US)

( * ) Notice: Subject to any disclaimer, the term of this patent is extended or adjusted under 35 U.S.C. 154(b) by 367 days.

(21) Appl. No.: 11/323,776

(22) Filed: Dec. 30, 2005

(65) Prior Publication Data

US 2007/0152903 A1 Jul. 5, 2007

(51) Int. Cl.
*H01Q 9/28* (2006.01)

(52) U.S. Cl. ..... 343/795; 343/818

(58) Field of Classification Search ..... 343/795, 343/818, 819

See application file for complete search history.

(56) References Cited

U.S. PATENT DOCUMENTS

| | | | |
|---|---|---|---|
| 4,977,041 | A | 12/1990 | Shiozawa et al. |
| 5,050,238 | A | 9/1991 | Tomizuka et al. |
| 5,061,944 | A | 10/1991 | Powers et al. |
| 5,164,683 | A | 11/1992 | Shields |
| 5,255,324 | A | 10/1993 | Brewer et al. |
| 5,548,239 | A | 8/1996 | Kohama |
| 5,625,894 | A | 4/1997 | Jou |
| 5,656,972 | A | 8/1997 | Norimatsu |
| 5,732,334 | A | 3/1998 | Miyake |
| 5,825,227 | A | 10/1998 | Kohama et al. |
| 5,880,635 | A | 3/1999 | Satoh |
| 5,969,560 | A | 10/1999 | Kohama et al. |
| 6,025,651 | A | 2/2000 | Nam |
| 6,046,703 | A | 4/2000 | Wang et al. |
| 6,075,995 | A | 6/2000 | Jensen |
| 6,118,985 | A | 9/2000 | Kawakyu et al. |
| 6,148,220 | A | 11/2000 | Sharp et al. |
| 6,151,509 | A | 11/2000 | Chorey |
| 6,175,279 | B1 | 1/2001 | Ciccarelli et al. |
| 6,183,703 | B1 | 2/2001 | Hsu et al. |
| 6,198,351 | B1 | 3/2001 | Winslow |
| 6,203,587 | B1 | 3/2001 | Lesieur et al. |
| 6,262,630 | B1 | 7/2001 | Eriksson |
| 6,265,943 | B1 | 7/2001 | Dening et al. |
| 6,281,755 | B1 | 8/2001 | Feld et al. |
| 6,281,762 | B1 | 8/2001 | Nakao et al. |
| 6,307,519 | B1 * | 10/2001 | Livingston et al. ..... 343/767 |
| 6,366,788 | B1 | 4/2002 | Fujioka et al. |
| 6,417,730 | B1 | 7/2002 | Segallis et al. |
| 6,462,622 | B1 | 10/2002 | Mori et al. |

(Continued)

OTHER PUBLICATIONS

U.S. Appl. No. 10/385,059.

(Continued)

*Primary Examiner*—Tho G Phan
(74) *Attorney, Agent, or Firm*—Tran & Associates

(57) ABSTRACT

Systems and methods are disclosed to transmit and receive radio frequency (RF) signals by providing a plurality of high gain, highly directional antennas on a multi-layer printed circuit board; using a processor to gate RF signals from each antenna and to select an antenna transmission pattern based on antenna turned on or the combination of a number of antennas turned on, among others.

12 Claims, 6 Drawing Sheets

U.S. PATENT DOCUMENTS 6,483,398 B2 11/2002 Nagamori et al.
6,496,684 B2 12/2002 Nakao et al.
6,625,050 B2 9/2003 Suwa et al.
6,630,372 B2 10/2003 Ball
6,639,466 B2 10/2003 Johnson
6,678,506 B1 1/2004 Dolman et al.
6,693,498 B1 2/2004 Sasabata et al.
6,694,129 B2 2/2004 Peterzell et al.
6,720,850 B2 4/2004 Sasabata et al.
6,774,718 B2 8/2004 Ichitsubo et al.
6,798,287 B2 9/2004 Wu et al.
6,822,515 B2 11/2004 Ichitsubo et al.
6,847,262 B2 1/2005 Ichitsubo et al.
6,914,482 B2 7/2005 Ichitsubo et al.
7,061,436 B2 * 6/2006 Izumi ..... 343/702
7,071,783 B2 7/2006 Ichitsubo et al.
2004/0203552 A1 10/2004 Horiuchi et al.
2004/0204037 A1 10/2004 He et al.
2005/0179498 A1 8/2005 Isutsui et al.
2005/0239415 A1 10/2005 Sagae et al.
2007/0103377 A1 * 5/2007 Abramov et al. ..... 343/818

OTHER PUBLICATIONS

U.S. Appl. No. 10/804,737.
U.S. Appl. No. 10/843,409.
U.S. Appl. No. 10/919,850.
U.S. Appl. No. 10/938,779.
U.S. Appl. No. 10/972,636.
U.S. Appl. No. 11/039,687.
U.S. Appl. No. 11/064,261.
U.S. Appl. No. 11/110,249.
U.S. Appl. No. 11/121,288.
U.S. Appl. No. 11/126,667.
U.S. Appl. No. 11/152,308.
U.S. Appl. No. 11/173,739.
U.S. Appl. No. 11/173,741.
U.S. Appl. No. 11/173,965.
U.S. Appl. No. 11/173,968.
U.S. Appl. No. 11/323,763.
U.S. Appl. No. 11/323,788.
U.S. Appl. No. 11/433,696.
U.S. Appl. No. 11/486,465.
U.S. Appl. No. 60/698,586.

* cited by examiner

PRINTED CIRCUIT BOARD BASED SMART ANTENNA

BACKGROUND

This invention relates to printed circuit board (PCB) based antennas.

Yagi antennas are used for various high-frequency applications such as the reception of television signals, point-to-point communications, and certain types of military communications. The Yagi antenna is typically made up of linear wire or rod-type elements, each having a length of approximately ½ wavelength. These elements are arranged in a row, with each element parallel to each other. The rear element in this array is called the reflector. The second element is the driven element, which is connected to the transmission line, and all other elements in front of the driven are called directors. The directors are typically positioned along an antenna axis with the directors extending in the transmission direction from the dipole. The transmission direction is that direction to which electromagnetic energy is to be transmitted, or from which signal energy is to be received. The gain of a single Yagi antenna ranges from about 6 to 20 dBi, depending upon the length of the array. Multiple Yagi antennas may be connected together side by side in larger arrays.

U.S. Pat. No. 5,061,944, the content of which is incorporated by reference, discloses the use of parasitic elements to allow the array of directors on the antenna axis to be about 25% shorter than would otherwise be required. Parasitic arrays can also be placed parallel to and adjacent to the distal end of the main array on the antenna axis to improve the directivity of the antenna, as is disclosed in U.S. Pat. No. 3,218,645. The described antenna is the to provide an increase in gain of 60%, which is equivalent to a decrease in length of about 38% compared to a standard Yagi antenna for the same gain. To provide even shorter antennas for the same gain, U.S. Pat. No. 5,612,706, the content of which is incorporated by reference, discloses a driven element disposed on an antenna axis for transmission of electromagnetic energy in a transmission direction along the antenna axis. First and second parasitic arrays are disposed on opposite sides of the antenna axis in the transmission direction from the driven element. At least a portion of the antenna axis adjacent to the parasitic arrays is without parasitic elements. Each parasitic array has a plurality of parallel parasitic elements or directors spaced apart along a respective array line that includes a proximal portion adjacent to the driven element that extends in a general direction that is at an acute angle to the transmission direction. The first and second parasitic arrays are sufficiently close to the antenna axis to produce a radiation pattern that has a lobe with greatest magnitude in the transmission direction.

The proper installation of a Yagi antenna typically requires the use of a signal strength indicator and/or external measurement equipment. An installer must aim the antenna at the time of installation. If a new transmitter site becomes available, the installer may have to revisit the site to reorient the antenna to take advantage of the stronger, closer transmitter. Hence, in addition to high material and assembly cost, Yagi antennas are also labor intensive during installation.

To minimize material and labor costs, U.S. Pat. No. 6,046,703, the content of which is incorporated by reference, discloses a wireless transceiver that includes a dielectric substrate having first and second major surfaces on which an RF circuit and a baseband processing circuit are mounted, and a printed circuit antenna formed on the substrate. The printed circuit antenna has at least one director formed by strip conductors disposed on the substrate, a reflector formed by the edge of a ground area disposed on the substrate, and a radiating element formed by strip conductors on the substrate. The radiating element is positioned between the reflector and the director.

SUMMARY

Systems and methods are disclosed to transmit and receive radio frequency (RF) signals by providing a plurality of high gain, highly directional antennas on a multi-layer printed circuit board; using a processor to gate RF signals from each antenna and to select an antenna transmission pattern based on the antennas turned on or the combination of multiple antennas turned on.

Advantages of the system may include one or more of the following. The system provides a printed circuit antenna with high gain, yet highly efficient in omni-directional as well as direct point-to-point radio communications. In addition to its light weight, the printed circuit antenna has the advantage that it can be formed at the same time and on the same substrate with other circuit sections. The wireless transceiver system can use this feature to make an integrated system on a printed circuit board to reduce the manufacturing time and cost. The absence of mechanical structures or connectors in the antenna construction also improves the reliability of the wireless transceiver system. The signals to and from the printed circuit antenna are directly linked to the radio frequency circuit to reduce the signal loss and to avoid any mechanical connection. This wireless system on a board is also compact and light weight.

DESCRIPTION

Figure 1A:
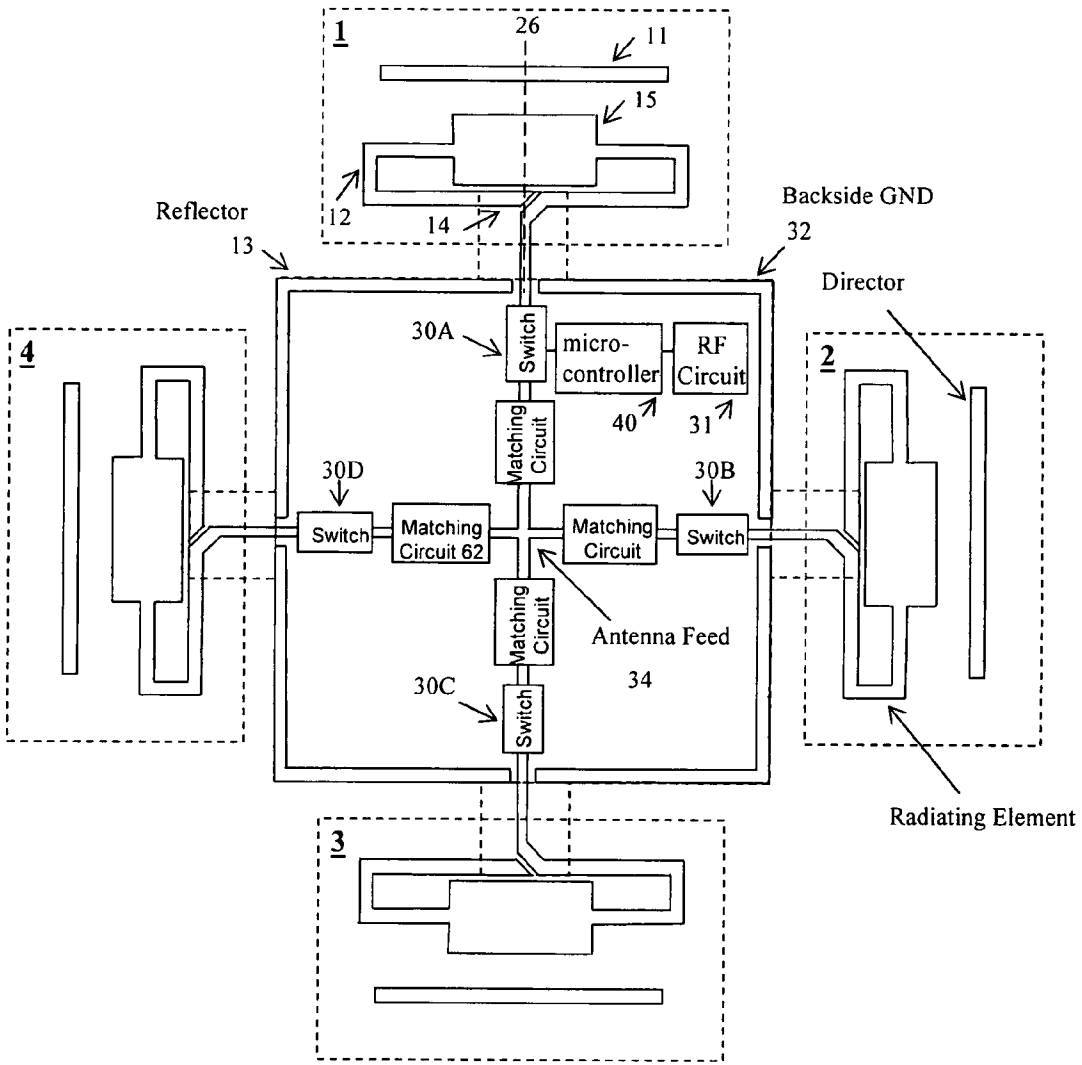
FIG. 1A is a front plan view of a plurality of printed circuit Yagi antennas according to one embodiment.

FIG. 1A shows a front plan view of a system having a plurality of directional printed circuit antennas 1-4. One exemplary antenna 1 will be described in detail next. The description of antenna 1 applies equally well to antennas 2-4.

As shown in FIG. 1A, the printed circuit Yagi antenna comprises one or more strip conductors called director 11 along the edge of the substrate, a reflector 13 formed by part of the ground area, and a driven element 12 positioned there between. The driven element 12 is a folded dipole. One end of the dipole is connected to a conductive line 14 on the same side of the substrate. The other end is connected to a conductive line on the other side of the substrate by means of plated through holes. All the linear dimensions scale with the wavelength in the intended operation frequency range. The central portion of the strip conductor of the folded dipole can be widened to adjust the impedance matching. Extra tuning capability can provide end-fire radiation along the axis 26 with directivity almost 7.5 dB above that of a single dipole antenna.

Figure 1B:
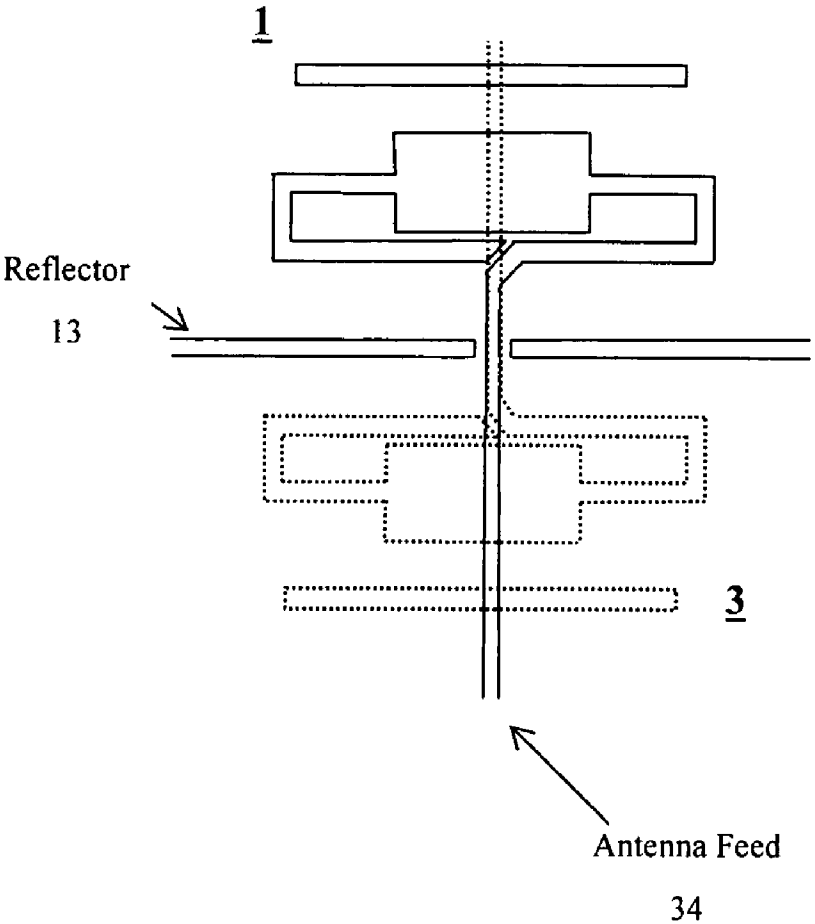
FIG. 1B shows two Yagi antennas on stacked layer of printed circuit board.

The terminal of the antenna 1 is provided to a switch 30A. Similarly, the terminals of the antenna 2, 3 and 4 are provided to switches 30B, 30C, and 30D, respectively. The output of switches 30A-30D are provided to respective matching circuits 62, which in turn are connected to an antenna feed 34. FIG. 1B shows another embodiment of antennas 1 and 3 of FIG. 1A on different layers of the printed circuit board. FIG. 1B also shows the relationship between the antennas 1 and 3, the reflector 13, and the antenna feed 34.

The switches 30A-30D are controlled by a processor 40, which can be a micro-controller. The processor 40 runs software to determine the best RF characteristics based on different antenna combinations as determined by switches 30A-30D. The overall transmission characteristics can be controlled by the number of antennas being connected together through the switches 30A-30D. The overall transmission characteristics can also be controlled a combination of multiple antennas being connected. The processor 40 connects the antennas 1-4 to an RF circuit 31. The RF circuit 31 can be surrounded by ground area 32.

In FIG. 1A-1B, the conductors which are invisible from the view are shown in dotted lines. The substrates are preferably constructed by conventional copper-clad epoxy fiberglass. In a second embodiment, the directional printed circuit antenna can have two strip directors along the edge of the substrate to provide a stronger directivity. In yet another embodiment, the folded dipole is replaced by a $\lambda/2$ dipole element. On end of the dipole element is connected to a conductive line 14 on the same side of the substrate. The other end is connected to a conductive line on the other side of the substrate by means of plated through holes.

Figure 1C:
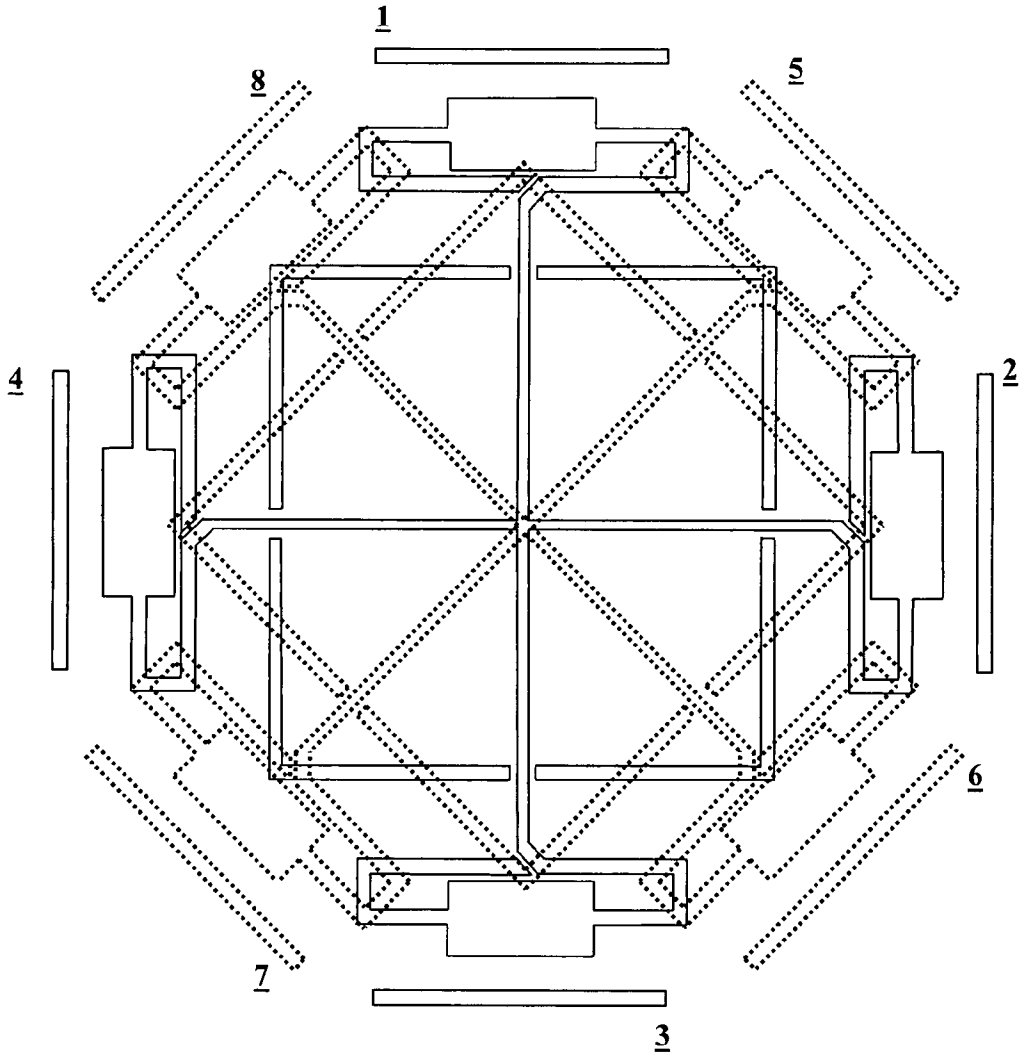
FIG. 1C shows a second embodiment having stacked antennas.

FIG. 1C shows a second embodiment having stacked antennas. In this embodiment, the antennas 1-4 of FIG. 1A are supplemented with additional antennas 5-8 formed on an additional layer such as a printed circuit board (PCB) layer. In the embodiment of FIG. 1C, the orientations of antennas 5-8 are shifted, rotated, angled or positioned at an angle relative to the antennas 1-4.

In one embodiment, multiple Yagi antennas are provided on multi-layers of PCB. This embodiment reduces size of the antenna sub-system. Further, the embodiment increases the number of stages in the individual antenna, providing a higher gain than possible with fewer Yagi antennas. The staggered Yagi antennas in different layers also improve Omni-directional performance.

The embodiment of FIG. 1C provides four additional reception/transmission angles and thus has better omni-directional characteristics than the antenna of FIG. 1A. In yet other embodiments, additional layers of antennas can be used, and the antennas can be stacked with or without any shifting or rotation of the antenna orientations.

Figure 2:
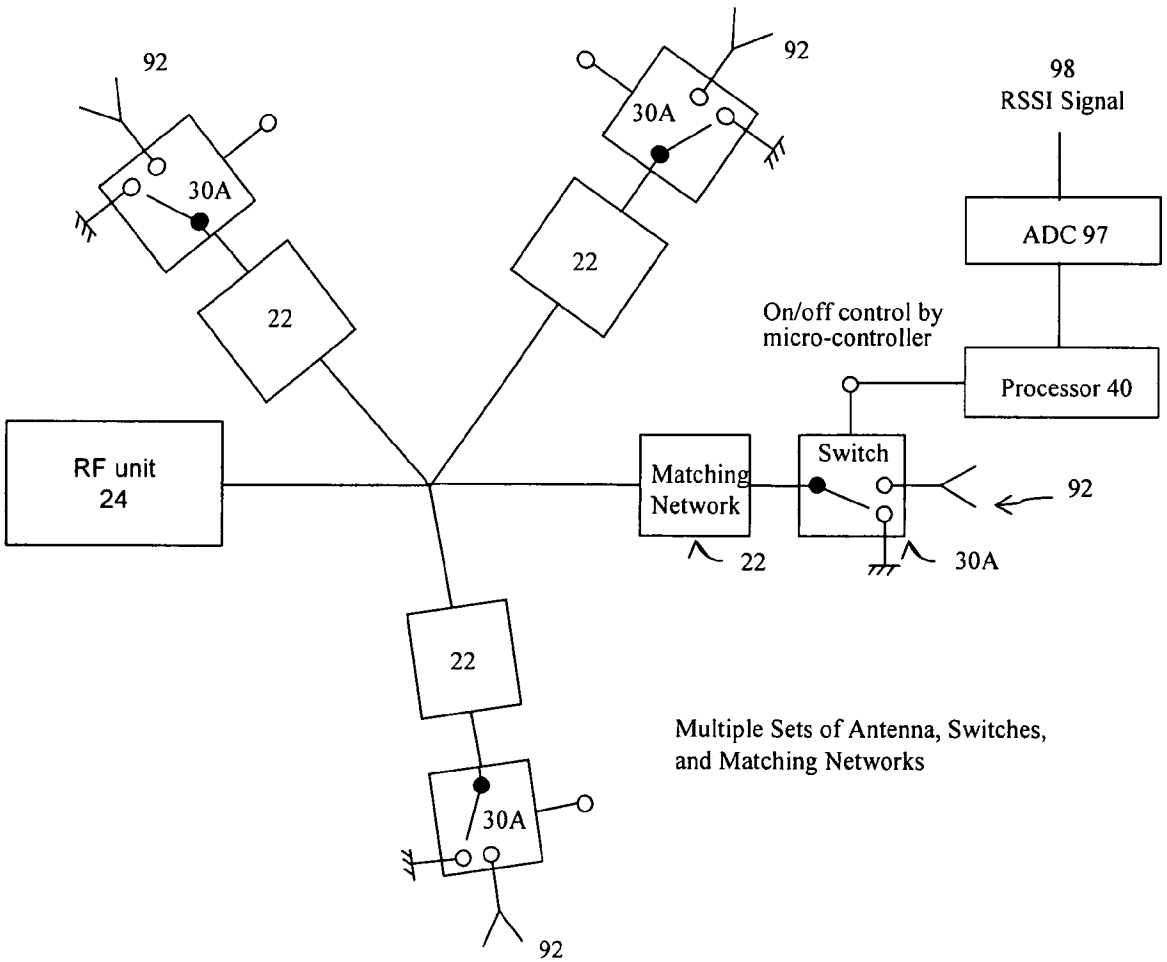
FIG. 2 is a schematic view of an antenna array with one exemplary PCB antenna circuit.

FIG. 2 shows one implementation of the system of FIG. 1A. In this case, exemplary antenna 92 includes a matching network 62 connecting to a common antenna terminal. The common terminal is then connected to a final matching network 62. The matching network 62 is connected to the switch 30A. The switch 30A is turned on and off by the processor 40. The processor 40 can receive an RSSI signal 98 through an analog to digital converter 97. The switch 30A is also connected to an antenna element 92 that receives or captures an RF signal. For reception, the RF signal captured by the antenna element 92 travels through the switch 30A and then through the matching network 62 to the common terminal and is received by RF unit 24. For transmission, the RF unit 24 drives RF energy into the terminal for transmission to antennas 92. With respect to each antenna 92, the RF signal travels through the matching network 62, through the switch 30A and through the antenna element to be radiated through the air waves.

Figure 3:
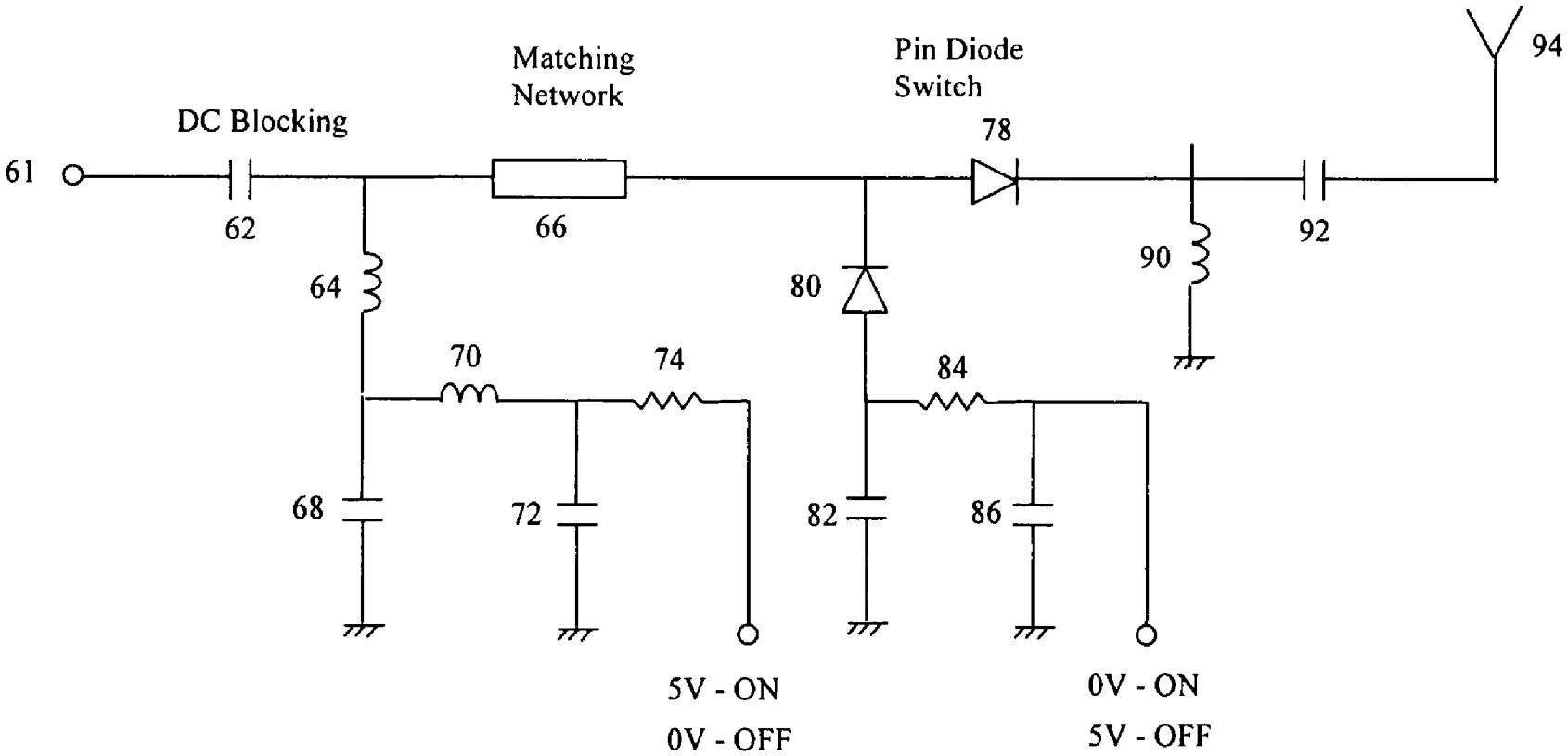
FIG. 3 shows an exemplary PIN diode embodiment of one antenna.

Turning now to FIG. 3, a discrete embodiment of the smart antenna system is shown. For transmission, RF signal is received at a terminal 61. The signal is provided to a capacitor 62 that provides DC blocking. The capacitor 62 is connected to a matching network with a resistor 66 and an inductor 64 connected in parallel. The resistor 66 can be 50 ohms or $\frac{1}{4}\lambda$ in one embodiment.

The inductor 64 is connected to a low pass filter having a capacitor 68, an inductor 70 and a capacitor 72. The inductor 70 and the capacitor 72 is connected to a resistor 74 which is connected to ground for a switch off condition or to VDD for a switch on condition.

The resistor 66 is connected to PIN diode switches 78-80. The diode 80 is connected to another low pass filter that includes capacitors 82 and 86 that are connected by a resistor 84 which is connected to ground for a switch off condition or to VDD for a switch on condition. The PIN diode 78 is connected to an inductor 90 and a DC blocking capacitor 92, which drives a PCB antenna element 94.

The processor 40 and other baseband processing circuit can be built on both sides of the substrate which are not occupied by the printed circuit antenna, the RF circuit and the ground. In one implementation, the backside ground plane of the RF components or module is soldered to the ground area of the substrate to insure good contact for the grounds. The signal path between different sections of the system including antenna, RF circuit, baseband processing circuit can be connected by metallic pins, leads, wires or plated-through holes.

Figure 4:
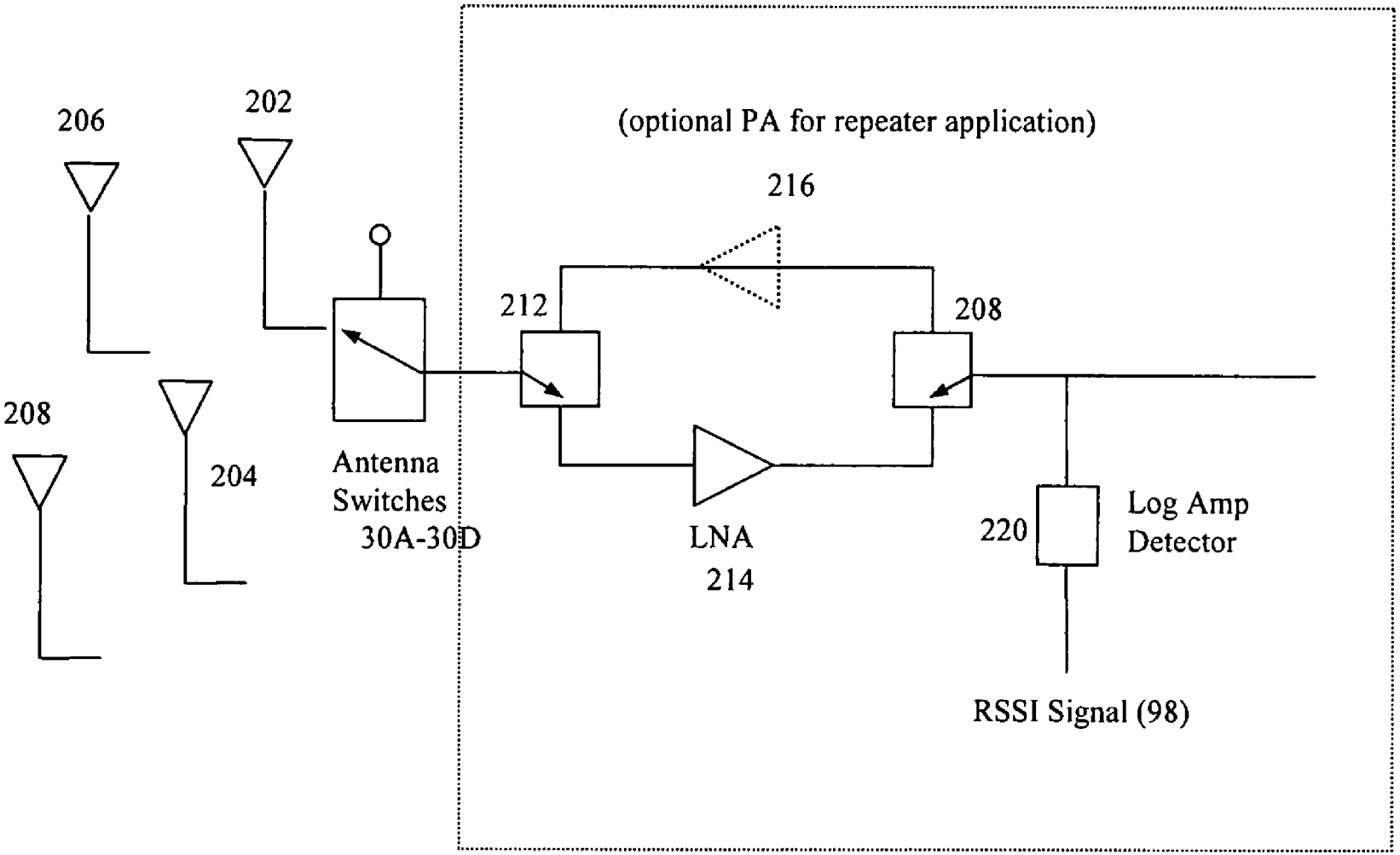
FIG. 4 shows one embodiment of a system with a Receiver Signal Strength Indicator (RSSI).

FIG. 4 illustrates an embodiment with an on-board RSSI circuit. A transceiver that wishes to take part in a power-controlled link must be able to measure its own receiver signal strength and determine if the transmitter on the other side of the link should increase or decrease its output power level. A Receiver Signal Strength Indicator (RSSI) makes this possible. In the embodiment of FIG. 4, a plurality of antennas 202-208 are connected through antenna switches 30A-30D, respectively. The output of switches 30A-30D are provided to a switch 212. For receiving, the switch 212 routes the RF signal through a low-noise amplifier (LNA) 214, whose output is provided to a second switch 208 that is connected to a log-amp detector 220 and other suitable receiving circuits. The log amp detector 220 output RSSI signal 98 can be used to control antenna switches and TX/RX path. The LNA 214 is used to improve the detector sensitivity. As an additional benefit, the LNA 214 can also improve receiver sensitivity. Optionally, a power amplifier (PA) 216 can be connected to the switches 208 and 212 to provide an active transmitting circuit. In another embodiment, a circuit with the LNA 214 and the optional PA 216 can be used as a repeater for the receiving and transmitting signals.

In one embodiment, a wireless system can include a dielectric substrate having an RF circuit and a baseband processing circuit mounted thereon; a printed circuit antenna including at least one director formed by a strip conductor on a first major surface of the substrate, a reflector formed by the edge of a ground area on the first major surface of the substrate, and a dipole antenna formed by a strip conductor on the first major surface of the substrate and positioned between the reflector and the director; and a feed structure to the dipole antenna including a first strip conductor disposed on the first major surface of the substrate and a second strip conductor disposed on a second major surface of the substrate, the second strip conductor on the second major surface being connected electrically to the dipole antenna on the first major surface by means of plated-through holes.

The dipole antenna is a folded dipole having a resonant frequency at the intended operating frequency of the dipole antenna. A center portion of the strip conductor of the folded dipole is widened for impedance matching. The dipole antenna can be a half wavelength dipole having a resonant frequency at the intended operating frequency of the dipole antenna. The dielectric substrate is a semi-insulating compound semiconductor substrate, and can be a micro strip on PCB, LTCC, or a silicon substrate, or a printed circuit board. The printed circuit board can also be constructed by copper-clad epoxy fiberglass.

In another embodiment, a wireless transceiver includes a dielectric substrate having an RF circuit and a baseband processing circuit mounted thereon. A printed circuit antenna is provided that includes at least one director formed by a strip conductor on the substrate, a reflector formed by the edge of a ground area on the substrate, and a dipole antenna formed by a strip conductor on the substrate and positioned between the reflector and the director. The RF circuit is constructed on a separate dielectric board to form a RF module having a backside ground plane soldered to the ground area of the substrate for insuring good ground contact, the signal paths between the printed circuit antenna, the RF module and the baseband processing circuit being connected by metallic pins wires, leads, or plated-through holes. The dipole antenna is a folded dipole having a resonant frequency at the intended operating frequency of the dipole antenna. A center portion of the strip conductor of the folded dipole is widened for impedance matching. The dipole antenna can be a half wavelength dipole having a resonant frequency at the intended operating frequency of the dipole antenna. The dielectric substrate can be a semi-insulating compound semiconductor substrate or alternatively a printed circuit board. The printed circuit board can be constructed by copper-clad epoxy fiberglass.

It is to be understood that various terms employed in the description herein are interchangeable. Accordingly, the above description of the invention is illustrative and not limiting. Further modifications will be apparent to one of ordinary skill in the art in light of this disclosure.

The invention has been described in terms of specific examples which are illustrative only and are not to be construed as limiting. The invention may be implemented in digital electronic circuitry or in computer hardware, firmware, software, or in combinations of them.

Apparatus of the invention for controlling the equipment may be implemented in a computer program product tangibly embodied in a machine-readable storage device for execution by a computer processor; and steps of methods may be performed by a computer processor executing a program to perform functions of the invention by operating on input data and generating output. Suitable processors include, by way of example, both general and special purpose microprocessors. Storage devices suitable for tangibly embodying computer program instructions include all forms of non-volatile memory including, but not limited to: semiconductor memory devices such as EPROM, EEPROM, and flash devices; magnetic disks (fixed, floppy, and removable); other magnetic media such as tape; optical media such as CD-ROM disks; and magneto-optic devices. Any of the foregoing may be supplemented by, or incorporated in, specially-designed application-specific integrated circuits (ASICs) or suitably programmed field programmable gate arrays (FPGAs).

Although an illustrative embodiment of the present invention, and various modifications thereof, have been described in detail herein with reference to the accompanying drawings, it is to be understood that the invention is not limited to this precise embodiment and the described modifications, and that various changes and further modifications may be effected therein by one skilled in the art without departing from the scope or spirit of the invention as defined in the appended claims.

What is claimed is:

1. An electronic circuit, comprising:

a multi-layer substrate;

a plurality of antennas formed on a first surface of the substrate;

a plurality of switches, each coupled to one antenna in the antenna array;

a processor coupled to the switches to control the plurality of antennas and to optimize radio frequency characteristics of the plurality of antennas;

a radio frequency (RF) circuit; and a ground circuit border surrounding the RF circuit except for narrow openings for passing signal paths.

2. The circuit of claim 1, wherein the substrate includes a radio frequency circuit and a processor integrated circuit.

3. The circuit of claim 1, wherein the antenna includes at least one director and a reflector.

4. The circuit of claim 3, comprising a ground plane on a second surface of the substrate.

5. The circuit of claim 4, comprising a matching network coupled to the switches.

6. The circuit of claim 1, wherein the substrate comprises one of: a semi-insulating compound semiconductor substrate, a micro-strip on printed circuit board, a copper-clad epoxy fiberglass, a Low Temperature Co-fired Ceramic (LTCC) substrate, a gallium arsenide substrate, a silicon substrate.

7. The circuit of claim 1, wherein the processor selects one or more antennas by scanning the received signal strength for individual antennas and the combination of antennas.

8. The circuit of claim 6, wherein the switches comprise one or more PIN diodes.

9. The circuit of claim 1, wherein the antennas comprise PCB Yagi antennas.

10. The circuit of claim 1, wherein the switches comprise at least one of a MESFET device, a HEMT device.

11. The circuit of claim 1, wherein one end of the switches is coupled to a receiver comprising a low noise amplifier, a down-converter, a demodulator and an automatic gain control (AGC) amplifier having a gain control voltage signal coupled to the processor.

12. The circuit of claim 1, comprising software to select an antenna transmission pattern based on a number of antennas turned on.

* * * * *